US005468145A

United States Patent [19]

Ferlin

[11] Patent Number: 5,468,145

[45] Date of Patent: Nov. 21, 1995

[54] SEALED GAS BURNER ASSEMBLY

[75] Inventor: William J. Ferlin, Plymouth, Mich.

[73] Assignee: Lincoln Brass Works, Inc., Detroit, Mich.

[21] Appl. No.: 185,464

[22] Filed: Jan. 24, 1994

[51] Int. Cl.[6] ..... F23Q 3/00

[52] U.S. Cl. ..... 431/266; 126/39 R; 126/39 H; 126/39 E; 431/264; 431/354

[58] Field of Search ..... 431/266, 278, 431/350, 354; 126/39 E, 39 H, 39 R

[56] References Cited

U.S. PATENT DOCUMENTS

| | | |
|---|---|---|
| 3,289,731 | 12/1966 | Geber . |
| 4,518,345 | 5/1985 | Pistien . |
| 4,565,523 | 1/1986 | Berkelder . |
| 4,572,154 | 2/1986 | Schweitzer . |
| 4,626,196 | 12/1986 | Strohrer, Jr. . |
| 4,627,411 | 12/1986 | Mertler . |
| 4,810,188 | 3/1989 | Kwiatek . |
| 4,846,671 | 7/1989 | Kwiatek . |
| 5,002,038 | 3/1991 | Riehl . |
| 5,040,970 | 8/1991 | Riehl . |
| 5,052,920 | 10/1991 | Warren et al. . |
| 5,083,915 | 1/1992 | Riehl . |
| 5,085,202 | 2/1992 | Riehl . |
| 5,112,218 | 5/1992 | Sigler . |
| 5,119,802 | 6/1992 | Cherry et al. . |
| 5,125,390 | 6/1992 | Riehl . |
| 5,133,334 | 7/1992 | Riehl . |
| 5,139,417 | 8/1992 | Ghassemzadeh . |
| 5,149,262 | 9/1992 | Riehl . |
| 5,152,276 | 10/1992 | Brock et al. . |
| 5,160,255 | 11/1993 | Sigler . |
| 5,160,256 | 11/1992 | Riehl . |
| 5,186,156 | 2/1993 | Ferlin . |

FOREIGN PATENT DOCUMENTS

| | | | |
|---|---|---|---|
| 525299A2 | 2/1993 | European Pat. Off. | 126/39 E |

*Primary Examiner*—Larry Jones
*Attorney, Agent, or Firm*—Harness, Dickey & Pierce

[57] ABSTRACT

A gas burner assembly has a burner cap which includes a burner port section defining a plurality of burner ports, a skirted section defining an harbor, and a base section. A plate is secured to the base section of the burner cap and in conjunction with the burner cap defines a gas chamber. An electrode assembly extends through an aperture in the plate and an aperture in the base section of the burner cap and is nested in the harbor formed by the skirted section of the burner port. The skirted section provides protection from both physical damage as well as from spills.

14 Claims, 3 Drawing Sheets

SEALED GAS BURNER ASSEMBLY

FIELD OF THE INVENTION

The present invention relates to sealed gas burners. More particularly, the present invention relates to a sealed gas burner having a uniquely integrated spark ignition device.

BACKGROUND OF THE INVENTION

Sealed gas burners are well known in the art and are normally disposed around a burner opening of a range top and secured in place around the periphery of the opening so that any spillage of food will remain on the range top and not pass between the burner head and the burner opening into the interior of the range. This type of assembly provides a streamline appearance which facilitates the cleaning and maintenance of the range top.

A sealed burner assembly typically includes a burner cap with a sidewall having a plurality of burner ports formed therein and through which the primary air/gas mixture is passed to the exterior of the burner cap for combustion. An electrode connected to an appropriate electrical circuit terminates on the exterior of the burner cap for providing spark ignition for the air/gas mixture. The use of spark ignition has become increasingly popular because it avoids the unnecessary energy consumption required by a standing ignitor pilot flame that has been used in the past to ignite gas range top burners. The electrode of the spark ignition system is normally in the form of a wire which extends upwardly through the base of the burner and is supported therein by an electrically insulated member. Various electrode designs have been proffered which include internal electrodes extending through the base into the gas chamber and exiting the gas chamber through the sidewall of the burner; and external electrodes protruding through the base and extending adjacent to the sidewall of the burner. The burner cap is manufactured from an electrically conductive material and is electrically connected to the range top which serves as an electrical ground potential for the spark ignition system. The electrode is electrically connected to a high voltage potential electrical circuit for providing ignition sparks between the electrode and the burner cap. The ignition sparks ignite the primary air/gas mixture passing through the burner ports to create the desired burner flame which is then supported by the secondary ambient air.

There are many known problems and disadvantages associated with prior art sealed gas burner assemblies, and particularly those provided with internal spark ignitors. For example, the spark created by the electrode jumps from the electrode to the burner body and ignites the primary air/gas mixture that flows through the spark. This ignition is difficult to achieve in a drawn sheet metal burner cap using an internal electrode because the main portion of the electrode is contained within the burner head to protect it from food spillovers. Since only the tip of the electrode protrudes out through the electrode aperture in the sidewall of the burner head, there is a tendency for the spark to randomly jump to the burner body in all directions, thus providing for a somewhat unreliable ignition of the primary air/gas mixture. A prior art attempt to overcome this problem with internal electrodes involves adding gas pathways formed integral with the electrode body or integral with the electrode aperture. These gas pathways are so located that during the sparking of the electrode in random directions, the gas will hopefully become ignited within a specified period of time.

This arrangement is not entirely reliable and addition of the integral pathways create a tool maintenance problem in the manufacturing of the burner assembly.

The designs of external electrodes which protrude from the base and extend adjacent to the exterior sidewall, while generating a more consistent spark pattern, suffer from the disadvantage that the electrode is susceptible to damage and/or food spills due to its location on the outside of the burner body. These disadvantages of the external electrode led to the development of the internal electrode with the opinion that the randomness pattern of the spark of an internal electrode was less of a problem than the susceptibility of damage and/or food spills associated with the external electrode.

Accordingly, there is a need for a spark ignition system which can provide a more consistent spark pattern to increase the reliability of the primary air/gas ignition while at the same time providing protection for the electrode from damage and/or food spills.

SUMMARY OF THE INVENTION

The present invention provides the art with a sealed gas burner which has an electrode protruding from the base and extending adjacent to the exterior surface of the burner cap sidewall. The burner cap sidewall includes an angular skirted portion which forms an harbor into which the electrode extends. The skirted harbor helps to protect the electrode from physical damage and allows for the placement of the electrode underneath the burner cap upper plate for protection of the electrode from spills.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
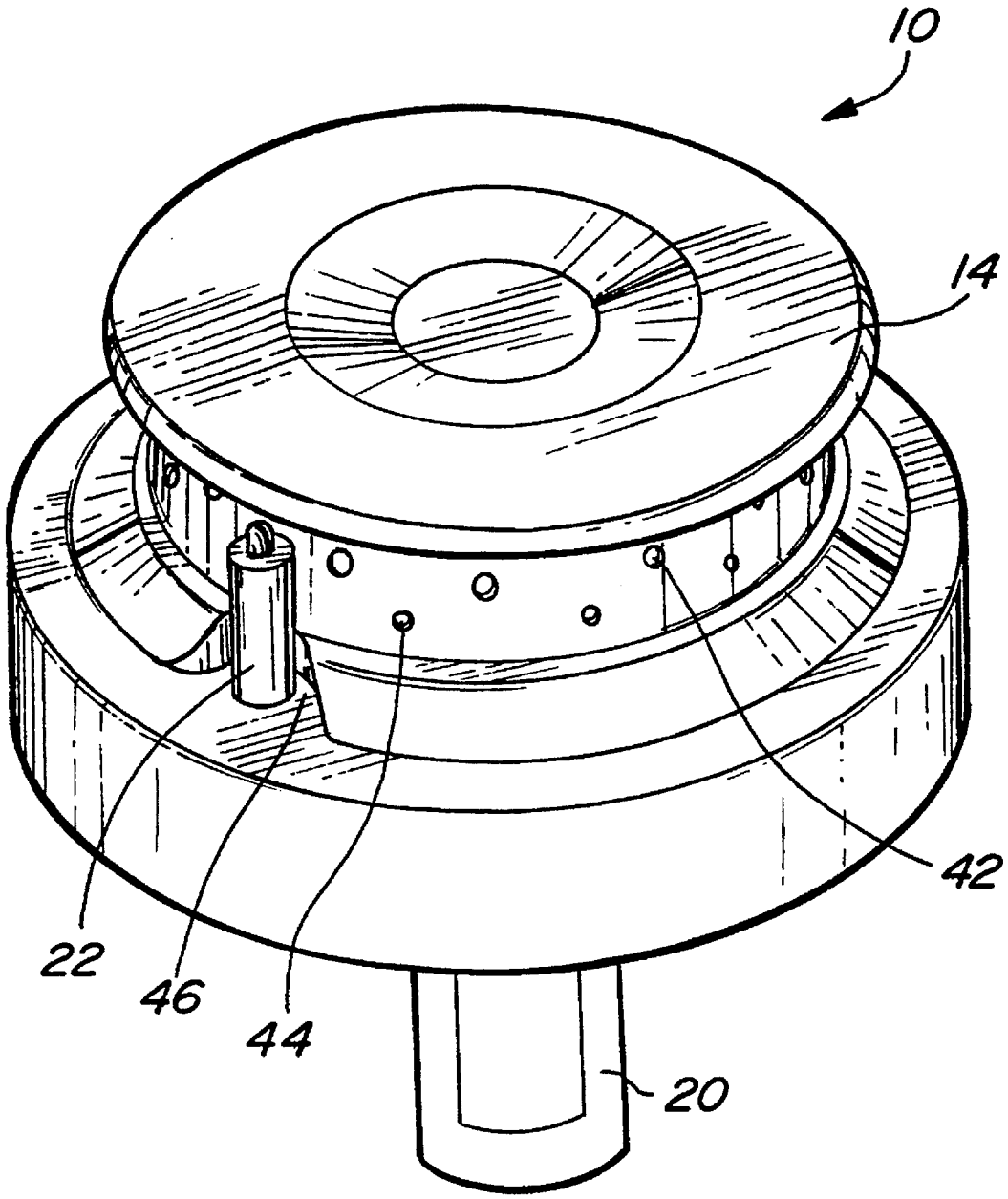
FIG. 1 is a perspective view of a burner assembly constructed in accordance with the present invention.
Figure 2:
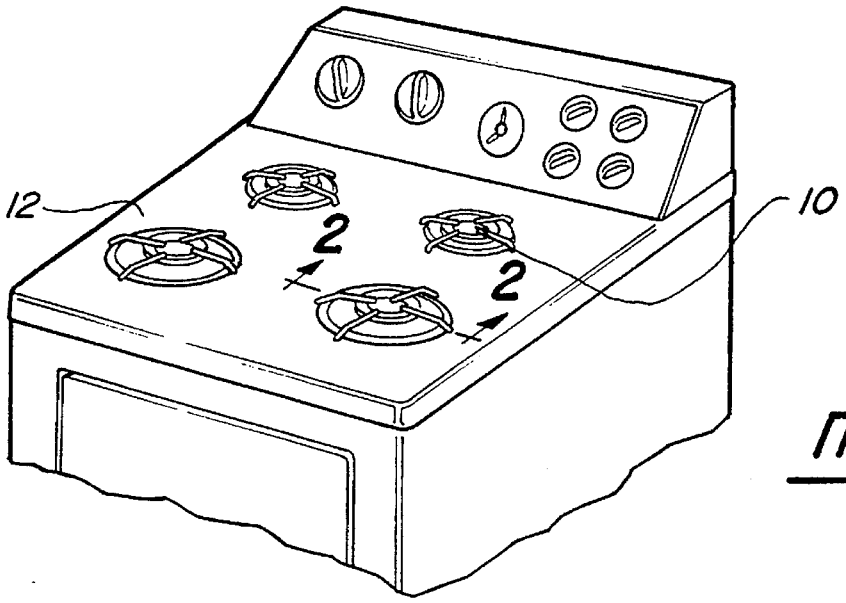
FIG. 2 is a perspective view of a range top incorporating the burner assembly in accordance with the present invention.

Referring now to the drawings in which like reference numerals designate like or corresponding parts throughout the several views, there is shown in FIGS. 1 through 4 a sealed burner assembly in accordance with the present invention which is designated generally the reference numeral 10. Burner assembly 10 is shown for exemplary purposes in FIG. 2 assembled into a range top or cooking top 12 which is electrically connected to an electrical ground. Burner assembly 10 comprises a burner cap 14, a burner mounting plate 16, a burner mounting bracket 18, a venturi tube 20 and an electrode assembly 22.

Figure 3:
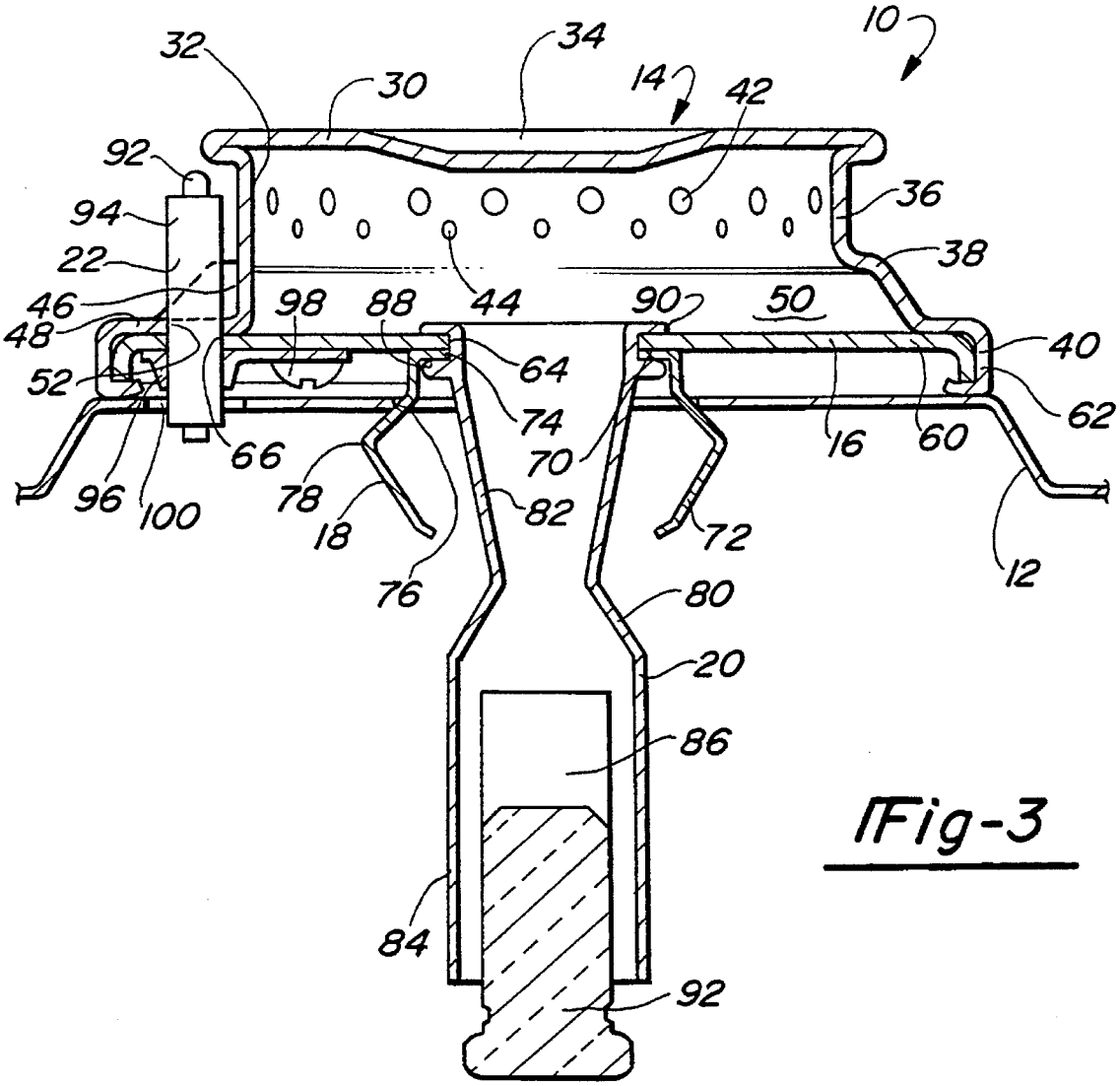
FIG. 3 is a longitudinal cross sectional view of the burner assembly shown in FIG. 1.
Figure 4:
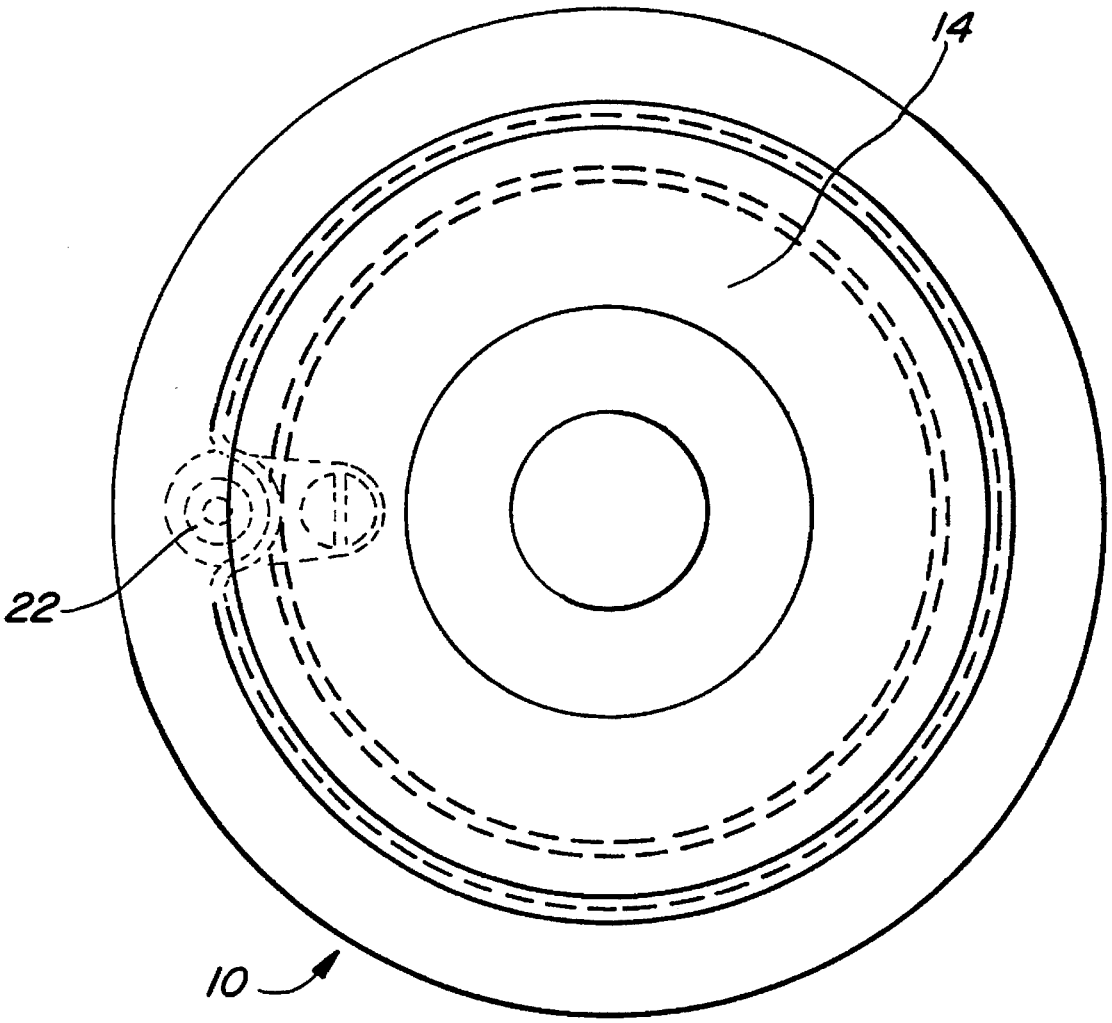
FIG. 4 is a plan view of the burner assembly shown in FIG. 1.

Burner cap 14 is an inverted cup shaped member having a top cap 30 and an annular sidewall 32. Burner cap 14 is formed of electrically conductive material, preferably stamped sheet metal of a #3003 aluminum alloy. An electrical ground potential is provided to burner cap 14 through range top 12 as part of the spark ignition system of burner assembly 10. The electrical grounding of burner cap 14 to range top 12 eliminates the need for a separate ground connection and an insulating spacer member. Top cap 30 is a generally circular cap having a centrally located circular indentation 34. Annular side wall 32 includes a burner port section 36, a skirted section 38 and a base section 40. Burner port section 36 is integral with top cap 30 and extends generally perpendicular from top cap 30. Burner port section 36 defines a first plurality of burner ports 42 and a second plurality of burner ports 44. Both first and second plurality of burner ports 42 and 44 are circumferentially spaced around top cap 30 as shown in FIGS. 1 and 3. Skirted section 38 extends angularly outward from burner port section 36 as shown in FIGS. 1 and 3. Skirted section 38 includes an harbor 46 within which electrode assembly 22 is nested. Skirted section 38 in conjunction with top cap 30 provides protection for electrode assembly 22 from physical damage as well as damage from food spills. In addition, skirted section 38 provides an aesthetically pleasant burner assembly appearance by blending electrode assembly 22 into burner assembly 10. Base section 40 extends from skirted section 38 in a direction generally perpendicular to burner port section 36 to form a shoulder 48 and then burner port section 36 turns to extend generally parallel to burner port section 36. The open end of base section 40 is circumferentially rolled or crimped around burner mounting plate 16 as shown in FIG. 3 to define a gas chamber 50. An electrode aperture 52 extends through base section 40 within the area of base section 40 which defines harbor 46. Aperture 52 provides access for electrode assembly 22 to extend along the exterior of burner cap 14 and be nested within harbor 46.

Burner mounting plate 16 includes a generally circular disc section 60 and a downwardly turned flange 62 located circumferentially around disc section 60. Disc section 60 includes a centrally located gas aperture 64 which is used for the mounting of venturi tube 20 and an electrode aperture 66 which is aligned with electrode aperture 52 located within harbor 46 of burner cap 14. Burner mounting plate 16 is secured to burner cap 14 by inserting mounting plate 16 into base section 40 such that disc section 60 rests against shoulder 48 and the open edge of base section 40 is rolled or crimped circumferentially over flange 62 so that it sandwiches burner mounting plate 16 within base section 40.

Burner mounting bracket 18 includes a generally rectangular base section 70 and a pair of wings 72 extending generally perpendicular to base section 70. Base section 70 includes a centrally located venturi aperture 74. Wings 72 are designed to elastically deform inward towards venturi tube 20 in order to pass through a burner aperture 76 located within range top 12. Once wings 72 are inserted beyond a knee 78 in wings 72, wings 72 spring back away from venturi tube 20 to retain burner assembly 10 within range top 12. Burner assembly 10 is pulled downward against range top 12 by the elastic deformation of wings 72 such that the crimped edge of base section 40 of burner cap 14 bears against range top 12 to support burner assembly 10. This attachment provides for simplified removal of burner assembly 10 from range top 12 for cleaning purposes. Once removed from range top 12, burner assembly 12 can be cleaned by hand or in an automatic dish washer. Burner mounting bracket 18 is sandwiched between venturi tube 20 and burner mounting plate 16 as shown in FIG. 3 during the assembly of venturi tube 20 with burner mounting plate 16.

Venturi tube 20 includes a converging section 80, a diverging section 82 and an inlet section 84 having a pair of air inlet openings 86. Venturi tube 20 further includes an annular flange 88 located near the upper end of diverging section 82. Venturi tube 20 is assembled to burner mounting plate 16 by first positioning burner mounting bracket 18 over venturi tube 20 with the open end of diverging section 82 extending through venturi aperture 74 of burner mounting bracket 18. Venturi tube 20 is then inserted through aperture 64 of burner mounting plate 16 and the open end of venturi tube 20 is rolled or formed over to produce an annular flange 90. The rolling over of the open end of venturi tube 20 to produce annular flange 90 produces a simple gas-tight crimp which sandwiches burner mounting bracket 18 between annular flange 88 and burner mounting plate 16 and sandwiches burner mounting plate 16 between burner mounting bracket 18 and annular flange 90. Thus both burner mounting bracket 18 and burner mounting plate 16 are secured to venturi tube 20 by being sandwiched between annular flanges 88 and 90.

When burner assembly 10 is mounted to the range top as shown in FIG. 3, a conventional gas nozzle 92 extends into the end of inlet section 84 of venturi tube 20 in the usual manner. Gas nozzle 32 injects gaseous fuel from a conventional gas line into inlet section 84. Air inlet openings 86 of inlet section 84 allow air to mix with the injected gas. An air shutter (not shown) may be provided for adjustment if desired. This air and gas mixture travels through inlet section 84 through converging section 80 and through diverging section 82 in an axial direction into gas chamber 50. The air and gas mixture exits gas chamber 50 from the first and second plurality of burner ports 42 and 44 in the usual manner.

Electrode assembly 22 includes electrode 92, insulator 94 and electrode bracket 96. Electrode 92 extends through insulator 94 with both the upper end and lower end of electrode 92 extending beyond the end of insulator 94. The lower end of electrode 92 is adapted for connection to the high voltage electrical circuit. Electrode 92 is selectively provided with a high voltage potential causing ignition sparks to be produced between electrode 92 and grounded burner cap 14. The upper end of electrode 92 is positioned adjacent to burner cap 10 to provide for a more reliable and a more repeatable ignition throughout the entire range of gas flow rates for burner assembly 10. Bracket 96 is secured to insulator 94 and is attached to burner mounting plate 16 by a screw 98 or other means known well in the art. Insulator 94 is formed of an electrically insulating material, such as alumina or a composition ceramic material with a hard finish for cleanability. Electrode 92 is an integral member formed of electrically conductive material such as #310 stainless steel. Bracket 96 mounts electrode assembly 22 onto burner mounting plate 16 such that electrode assembly 22 extends through apertures 66 and 52 and into harbor 46 with the upper end of electrode 92 positioned for reliable and repeatable sparking with burner cap 14. The lower end of insulator 94 and electrode 92 extend through an electrode aperture 100 located in range top 12 in order to be electrically connected to the high voltage electrical circuit associated with range top 12.

While the above detailed description describes the preferred embodiment of the present invention, it should be understood that the present invention is susceptible to modification, variation and alteration without deviating from the scope and fair meaning of the subjoined claims.

what is claimed is:

1. A gas burner assembly comprising:

a burner cap having a burner port section defining a plurality of burner ports, a skirted section having a localized recessed area defining a harbor, and a base section, said skirted section being angularly disposed between said burner port section and said base section, said base section defining a shoulder having a first electrode aperture, said first electrode aperture located within said harbor defined by said skirted section;

a plate disposed within said base section, said plate in conjunction with said burner cap defining a gas chamber, said gas chamber being supplied with an air/gas mixture, said plate further defining a second electrode aperture in general alignment with said first electrode aperture; and an electrode assembly extending through said first and second electrode apertures into said harbor formed by said skirted section of said burner cap, said electrode assembly being disposed outside of said gas chamber adjacent to said burner port section.

2. The gas burner assembly according to claim 1 further comprising a venturi tube secured to said plate and extending through a gas aperture defined by said plate, said venturi tube forming a venturi for enhancing said air/gas mixture supplied to said gas chamber.

3. The gas burner assembly according to claim 2 wherein said venturi tube has an inlet tube extending from said venturi tube, said inlet tube defining at least one air opening through the wall thereof.

4. The gas burner assembly according to claim 1 further comprising a burner mounting bracket, said burner mounting bracket detachably mounting said gas burner assembly to a range top.

5. The gas burner assembly according to claim 1 wherein said electrode assembly comprises a generally cylindrical insulator defining a central passage and a longitudinally extending electrode disposed within said central passage, said electrode having a first end extending from one end of said insulator and disposed adjacent said burner cap, said electrode having a second end extending from the opposite end of said insulator, said second end adapted for electrical connection to a source of high voltage potential.

6. The gas burner assembly according to claim 1 wherein said burner cap is formed from a single piece of electrically conductive material.

7. The gas burner assembly according to claim 1 wherein said plate is secured to said burner cap by a circumferentially extending crimp.

8. The gas burner assembly according to claim 1 wherein said electrode assembly further comprises a bracket secured to said insulator and to said plate.

9. A gas burner assembly comprising:

a burner cap having a burner port section defining a plurality of burner ports, a skirted section having a localized recessed area defining a harbor, and a base section, said skirted section being angularly disposed between said burner port section and said base section, said base section defining a shoulder having a first electrode aperture, said first electrode aperture located within said harbor defined by said skirted section;

a plate disposed within said base section, said plate in conjunction with said burner cap defining a gas chamber, said gas chamber being supplied with an air/gas mixture, said plate further defining a second electrode aperture in general alignment with said first electrode aperture;

an electrode assembly extending through said first and second electrode apertures into said harbor formed by said skirted section of said burner cap, said electrode assembly being disposed outside of said gas chamber adjacent to said burner port section, said electrode assembly including a generally cylindrical insulator defining a central passage and a longitudinally extending electrode disposed within said central passage, said electrode having a first end extending from one end of said insulator and disposed adjacent said burner cap, said electrode having a second end extending from the opposite and of said insulator, said second end adapted for electrical connection to a source of high voltage potential; and a venturi tube secured to said plate and extending through a gas aperture defined by said plate for supplying said air/gas mixture to said gas chamber, said venturi tube forming a venturi for enhancing said air/gas mixture supplied to said gas chamber.

10. The gas burner assembly according to claim 9 wherein said venturi tube has an inlet tube extending from said venturi tube, said inlet tube defining at least one air opening through the wall thereof.

11. The gas burner assembly according to claim 9 further comprising a burner mounting bracket, said burner mounting bracket detachably mounting said gas burner assembly to a range top.

12. The gas burner assembly according to claim 9 wherein said burner cap is formed from a single piece of electrically conductive material.

13. The gas burner assembly according to claim 9 wherein said plate is secured to said burner cap by a circumferentially extending crimp.

14. The gas burner assembly according to claim 9 wherein said electrode assembly further comprises a bracket secured to said insulator and to said plate.

* * * * *

UNITED STATES PATENT AND TRADEMARK OFFICE

CERTIFICATE OF CORRECTION

PATENT NO. : 5,468,145

DATED : November 21, 1995

INVENTOR(S) : William J. Ferlin

It is certified that error appears in the above-indentified patent and that said Letters Patent is hereby corrected as shown below:

On the Title Page Item [56] under reference 5,160,255, "11/1993" should be — 11/1992 —.

In the Abstract, line 3, "an" should be — a —.

On the Title Page under Attorney, Agent, or Firm, "Harness, Dickey & Pierce" should be — Harness, Dickey & Pierce, P.L.C. —.

Column 2, line 27, "an" should be — a —.

Column 3, line 16, "an" should be — a —.

Column 4, line 65, "what" should be — What —.

Column 6, line 25, "and" should be — end —.

Signed and Sealed this

Twenty-eighth Day of May, 1996

*Attest:*

Bruce Lehman

BRUCE LEHMAN

*Attesting Officer*

*Commissioner of Patents and Trademarks*